US011006804B2

(12) United States Patent
Windorfer

(10) Patent No.: US 11,006,804 B2
(45) Date of Patent: May 18, 2021

(54) AUTOMATICALLY TRAVELING FLOOR CLEANING APPLIANCE AND METHOD FOR OPERATING A FLOOR CLEANING APPLIANCE

(71) Applicant: Vorwerk & Co. Interholding GmbH, Wuppertal (DE)

(72) Inventor: Harald Windorfer, Mettmann (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 0 days.

(21) Appl. No.: 14/029,948

(22) Filed: Sep. 18, 2013

(65) Prior Publication Data

US 2014/0075689 A1 Mar. 20, 2014

(30) Foreign Application Priority Data

Sep. 19, 2012 (DE) ..... 10 2012 108 802.0

(51) Int. Cl.

| | |
|---|---|
| ***A47L 11/24*** | (2006.01) |
| ***A47L 9/28*** | (2006.01) |
| ***A47L 9/04*** | (2006.01) |

(52) U.S. Cl.

CPC ..... *A47L 11/24* (2013.01); *A47L 9/0488* (2013.01); *A47L 9/2826* (2013.01); *A47L 9/2831* (2013.01); *A47L 2201/04* (2013.01); *A47L 2201/06* (2013.01)

(58) Field of Classification Search

CPC .. A47L 9/2826; A47L 9/2852; A47L 2201/06; A47L 2201/04; A47L 11/24

USPC ..... 134/6; 15/21.1

See application file for complete search history.

(56) References Cited

U.S. PATENT DOCUMENTS

| | | | | |
|---|---|---|---|---|
| 5,341,540 A * | 8/1994 | Soupert | ..... | A47L 11/4011 15/319 |
| 6,809,490 B2 * | 10/2004 | Jones | ..... | G05D 1/0219 318/568.12 |
| 2005/0171644 A1 * | 8/2005 | Tani | ..... | 700/253 |

(Continued)

FOREIGN PATENT DOCUMENTS

| | | |
|---|---|---|
| DE | 10 2008 014 912 A1 | 9/2009 |
| DE | 10 2010 036 772 A1 | 2/2012 |

(Continued)

*Primary Examiner* — Mikhail Kornakov
*Assistant Examiner* — Ryan L Coleman
(74) *Attorney, Agent, or Firm* — Collard & Roe, P.C.

(57) ABSTRACT

An automatically traveling floor cleaning appliance during travel is capable of traveling over low obstacles extending lengthwise, typically represented by a carpet border, having an upwardly inclined obstructing surface, with a direction of travel at a right or acute angle with respect to a longitudinal extent of the obstacle. The appliance also has an obstacle detector. The appliance is formed so that the obstacle or an area adjoining same may be cleaned using a procedure in which the appliance assumes a direction of travel based on the extent of the obstacle, and with regard to the obstructing surface includes traveling on a floor area in front of the obstacle, and at a lateral distance of an associated boundary edge of the appliance in the direction of travel from the obstructing surface which is smaller than that corresponding to a width of the appliance perpendicular to the direction of travel.

12 Claims, 3 Drawing Sheets

(56) References Cited

U.S. PATENT DOCUMENTS

| | | | | |
|---|---|---|---|---|
| 2007/0234492 | A1* | 10/2007 | Svendsen | A47L 5/30 15/21.1 |
| 2007/0267570 | A1* | 11/2007 | Park et al. | 250/221 |
| 2007/0271004 | A1* | 11/2007 | Kim et al. | 700/245 |
| 2010/0037418 | A1* | 2/2010 | Hussey | A47L 5/30 15/319 |
| 2012/0125363 | A1* | 5/2012 | Kim et al. | 134/6 |

FOREIGN PATENT DOCUMENTS

| | | |
|---|---|---|
| DE | 10 2011 000 250 A1 | 7/2012 |
| DE | 10 2011 000 536 A1 | 8/2012 |

* cited by examiner 12
11
R
V
14
13
16
10
6
1

1
2
3
6
10
11
13
14
16
17

5
16
19
7
4
20
15
18
9
3
2
19
8
S
1
b

AUTOMATICALLY TRAVELING FLOOR CLEANING APPLIANCE AND METHOD FOR OPERATING A FLOOR CLEANING APPLIANCE

CROSS REFERENCE TO RELATED APPLICATIONS

Applicant claims priority under 35 U.S.C. § 119 of German Application No. 10 2012 108 802.0 filed Sep. 19, 2012, the disclosure of which is incorporated by reference.

BACKGROUND OF THE INVENTION

1. Field of the Invention

The invention relates in first instance to an automatically traveling floor cleaning appliance, the floor cleaning appliance during travel being capable of traveling over low obstacles extending lengthwise, typically represented by a carpet border, having an upwardly inclined obstructing surface, with a direction of travel at a right angle or acute angle with respect to a longitudinal extent of the obstacle, and in addition the floor cleaning appliance having a means for detecting the obstacle.

In the same way, the invention relates to a method for operating an automatically traveling floor cleaning appliance which has the above-mentioned capabilities and means.

2. Description of the Related Art

These types of floor cleaning appliances are already known in many respects. Reference is made to DE 102011000536 A1, DE 102008014912 A1, DE 102011000250 A1, and DE 102010036772 A1, for example.

Such automatically traveling floor cleaning appliances are also able to overcome fairly small obstacles having an edge that is upwardly inclined, i.e., raised or elevated with respect to the surface on which the appliance is traveling just before reaching the obstacle, such as carpet borders in particular, but also possibly floor thresholds.

The cleaning strategy of these types of floor cleaning appliances is designed, for example, such that a certain space that is selected for cleaning, which may be the same as a room of a building or also may pertain to (only) a portion of a room of a building, is traveled over in a certain regular sequence, so that the action of a cleaning brush and/or suction of dirt with regard to the surface traveled over is provided over the most complete area coverage possible. The mentioned obstacles, which may be traveled over, possibly present within this cleaning strategy, are in each case traveled over in the direction of the pattern internally predefined in the robotic cleaner or in a certain orientation with respect to a given wall of a room. The obstacles may also be traveled over multiple times.

SUMMARY OF THE INVENTION

Starting from the above-mentioned prior art, it is an object of the invention to provide an automatically traveling cleaning appliance and a method for operating such a floor cleaning appliance, which allow even more effective cleaning.

According to a first inventive concept for an automatically traveling floor cleaning appliance, one possible approach to achieving this object is provided in that a procedure for cleaning the obstacle or an area adjoining the obstacle may be carried out in which the cleaning appliance assumes a direction of travel that is based on the extent of the obstacle, and with regard to the obstructing surface includes traveling on a floor area in front of the obstacle, and at a lateral distance of an associated boundary edge of the appliance in the direction of travel from the obstructing surface, which is smaller than that corresponding to a width of the appliance perpendicular to the direction of travel. Notwithstanding the possibility, which may also be utilized or initially utilized in the further course of cleaning a room, of traveling over the obstacle and also cleaning the obstacle (a carpet, for example), a configuration is hereby provided, which allows the floor cleaning appliance to travel along the lengthwise-extending obstacle in a targeted mariner, i.e., along a carpet border, for example. A corresponding end face of the obstacle, which is also referred to here as an upwardly inclined obstructing surface or an area portion directly in front of the obstructing surface, may thus be cleaned in a targeted manner. In particular, the floor cleaning appliance may also move along the obstructing surface on the floor area, which is present in front of the obstacle, i.e., which is situated correspondingly lower, in such a way that during a cleaning pass there is no contact of the obstructing surface with, for example, the bristles of brushes of the cleaning appliance. In particular, a plurality of such cleaning passes may also be provided by programming, each of the cleaning passes coming respectively closer to the obstructing surface, for example until contact by bristles via brushes of the appliance occurs during such a cleaning pass, or even until the appliance with regard to its cleaning brushes travels at least partially in overlap with the obstructing surface.

Due to the fact that the floor cleaning appliance may thus take account of the lengthwise-extending obstacles, which may be traveled over, in a cleaning strategy by changing or adapting the direction of travel in a targeted manner, the floor cleaning appliance may also correspondingly clean the obstacle itself, for example after a separate completed cleaning of the upwardly inclined obstructing surface, without in each case traveling over the upwardly inclined obstacle edge, for example. The floor cleaning appliance then only travels on the obstacle, for example, in a specific time period or until the particular cleaning has concluded. This is meaningful in particular when the base surface of the obstacle has a certain dimension in relation to the base surface of the floor cleaning appliance; i.e., for example, the width and/or length of the obstacle correspond(s) to at least two times or more of a dimension of the floor cleaning appliance in the customary direction of travel.

In a method for operating such an automatically traveling floor cleaning appliance, another possible approach to achieving the object is provided in that after detecting the obstacle, the floor cleaning appliance changes its direction of travel in such a way that it travels along this obstacle in the direction of travel at a distance from an associated boundary edge of the appliance, which is smaller than that corresponding to a width of the appliance perpendicular to this direction of travel. This type of modification may be made immediately after the first time the obstacle or the obstructing surface is traveled over; however, it may also be made (only) after a customary traversal in the room according to a pattern predefined per se, or between such events, i.e., between the first time or multiple times that the obstructing surface or the obstacle is traveled over and the completion of the cleaning according to a cleaning strategy provided per se.

Further features of the invention are described and illustrated below, also in the description of the figures and in the drawings, often in their preferred association with the concept explained above. However, they may also be of importance in an association with only one or more individual features which are described herein or illustrated in the drawings, or independently or in some other overall concept.

In this type of floor cleaning appliance, which also arises from the publications cited at the outset, and which are included in the disclosure of the present application, including for the purpose of incorporating features of these prepublished publications in claims of the present application, also with regard to the embodiments of room detection by contactless scanning, possible sensor configurations, etc., described therein, it is particularly preferred that a microprocessor is provided, it being also particularly preferred that a volatile and/or a nonvolatile memory is/are associated with the microprocessor, with which programs, in particular traversing programs, i.e., the implementation of cleaning strategies, may be carried out. It is further preferred that such a floor cleaning appliance has a surface area and/or room detection capability, for example by contactless scanning, as discussed, in particular infrared and/or sensor scanning by means of one or more sensors provided in the floor cleaning appliance, in particular ultrasound and/or infrared sensors, for example, being possible here. It is further preferred that the appliance may thus create a mapping of a room or a plurality of rooms to be cleaned in a dwelling, for example, also optionally in the course of "teach-in" travel, and subsequently carry out cleaning passes based on this mapping.

An upwardly inclined obstructing surface, which may be traveled over by this type of floor cleaning appliance, generally involves obstructing surfaces which are vertically elevated by several millimeters, for example 1 mm to up to 20, 30, or 40 mm, with respect to the surrounding floor. Also relevant within the scope of these statements are upwardly inclined obstructing surfaces in which the mentioned vertical distance of the obstructing surface due to the upward incline is very abrupt or immediate, or step-like, but in any case over an area that is up to several centimeters, measured perpendicular to a course of such an obstacle edge, for example 5 to 20 mm.

Another preferred embodiment provides that after a lengthwise-extending obstacle that can be traveled over has been detected and the direction of travel has been changed in such a way that [the floor cleaning appliance] travels along this obstacle, the lengthwise travel is made by means of a computer-assisted orientation of the direction of travel in such a way that a corresponding brush of the cleaning appliance cleans the obstacle edge, in particular the upwardly inclined obstructing surface, in the most effective manner possible. For example, it may be provided that a disk brush, which is a brush having a substantially vertical axis of rotation, and, as explained in greater detail below, preferably is a brush that protrudes beyond a plan view contour of a housing of the floor cleaning appliance with regard to an area of rotation of bristles of this brush, travels approximately centrally with respect to the obstacle edge, or in such a way that the obstacle edge in a manner of speaking forms a tangent, or a slightly inward secant, with regard to a bristle circle fanned by the rotating bristles, during the travel.

Additionally or alternatively, a multiple traversal along the obstacle edge may occur, in that case, for example, also with a different distance of the housing boundary edge (which extends with respect to the obstacle boundary edge in the direction of travel), or overlapping or not overlapping with the obstacle boundary edge, in such a way that during a traversal the mentioned disk brush, for example, cleans the obstacle boundary edge in the most effective manner possible, whereas in a different traversal a cleaning brush cleans, which has a substantially horizontal axis of rotation situated within the plan view contour of the housing.

The obstacle traveled over may be detected by the floor cleaning appliance in various ways.

Thus, on the one hand it is possible for a change in the distance from the floor to be detected by means of a floor sensor and appropriately evaluated. In this regard, these types of floor cleaning appliances often have a floor sensor, which is intended to prevent travel over a step, and thus to prevent the floor cleaning appliance from falling down stairs. For this purpose, such a floor sensor is often arranged in the front region, relative to a customary cleaning direction of travel of the floor cleaning appliance.

However, as described in greater detail below, in the present context a special arrangement is proposed.

In addition, as mentioned above, the floor cleaning appliance may have a brush, preferably formed as a corner brush, also preferably having a substantially vertical axis of rotation, the brush in any case having bristles extending beyond the housing plan view contour during rotation, and making it possible to detect when the obstacle, which may be traveled over, is reached or traveled over, based on a change in the motor current of an electric motor driving such a corner brush.

Furthermore, the floor sensor may also be formed as a contact sensor. Such a sensor is also referred to as a tactile sensor. Reaching or traveling over an obstacle which may be traveled over, and thus a detectable change in the vertical height of the floor traveled over, may then be detectable by direct contact. A contact sensor may be formed, for example, as a sliding foot, which rests on the floor and which may vertically yield. As the result of a chamfer, a spherical or hemispherical shape, or a convex curvature, preferably provided in the direction of travel, optionally all the way around, it can be prevented as a result of such a contact sensor that the floor appliance gets caught and thus gets stuck on obstacles.

The floor cleaning appliance may also have a wall-following sensor. This type of sensor is customarily provided to allow travel along a wall, at least with regard to a particular pass by the cleaning appliance, often also an initial pass during detection of a space to be cleaned. In the present context, this wall-following sensor may be used to assess a signal of a floor sensor, as described, in combination with a signal of the wall-following sensor. If a signal of the floor sensor, but not of the wall-following sensor, is detected, this may be assessed in such a way that an obstacle, which may be traveled over, but not, for example, a border which transitions into a wall, is present.

It is also preferred that the floor cleaning appliance, as previously described, has a housing, having a housing contour based on a top view, with one or more wheels having a running surface, and has at least one cleaning brush, which has a longitudinal axis, the wheel and the cleaning brush also being situated within the housing contour, and the floor sensor, based on the same top view, being situated in a sector of the housing contour, which is delimited by the longitudinal axis of the cleaning brush and a perpendicular with respect to a geometric wheel axis, the perpendicular extending directly outside the running surface on the side of the running surface facing a boundary edge of the housing.

When a disk brush is provided, it may also be completely or partially present in the mentioned sector. This disk brush is also situated on the other side of the cleaning brush, viewed from a running wheel.

In particular, when the cleaning brush extends, in the direction of its longitudinal axis, beyond the wheel or the running surface thereof toward the boundary edge of the housing, the mentioned delimitation of the sector, at least in this outwardly extending portion of the cleaning brush, is preferably also provided by an axis which extends parallel to the axis of the cleaning brush, and which represents a delimitation of the cleaning brush on the wheel side, generally based on the radial bristle length of the cleaning brush.

The mentioned sector may also be provided in this form for only one wheel of the floor cleaning appliance. If this involves a wheel which is pivotable for change of the direction of travel, the definition preferably refers to the position of the wheel during straight-ahead travel.

However, a configuration is preferred in which two wheels are provided, which are also further preferably situated on a common axis that extends parallel to the axis of the cleaning brush.

As a result of this measure, the floor sensor is provided in an arrangement which allows the floor cleaning appliance to travel along an obstacle edge, such as the border of a carpet, the floor sensor already overlapping the carpet, i.e., registering a comparatively low vertical height, although the (associated) wheel and/or the associated brush is/are still at the level of the floor therebeneath.

The obstacle may also be detected by evaluating the motor current consumption of a corner cleaning brush, when such is provided, i.e., in particular a corner cleaning brush in the form of a disk brush. When an obstacle is encountered or traveled over, the torque and thus the motor current changes, thus making this evaluation possible.

Alternatively or additionally, the evaluation may be carried out by means of the above-mentioned tactile sensor or contact sensor. A signal supplied by this sensor may also then be correspondingly evaluated, optionally also in conjunction with the signal of a wall-following sensor.

BRIEF DESCRIPTION OF THE DRAWINGS

The invention is explained in greater detail below with reference to the accompanying drawings, which, however, illustrate only one exemplary embodiment. The drawings show the following.

DETAILED DESCRIPTION OF PREFERRED EMBODIMENTS

An automatically traveling floor cleaning appliance 1 is illustrated and described.

Figure 3:
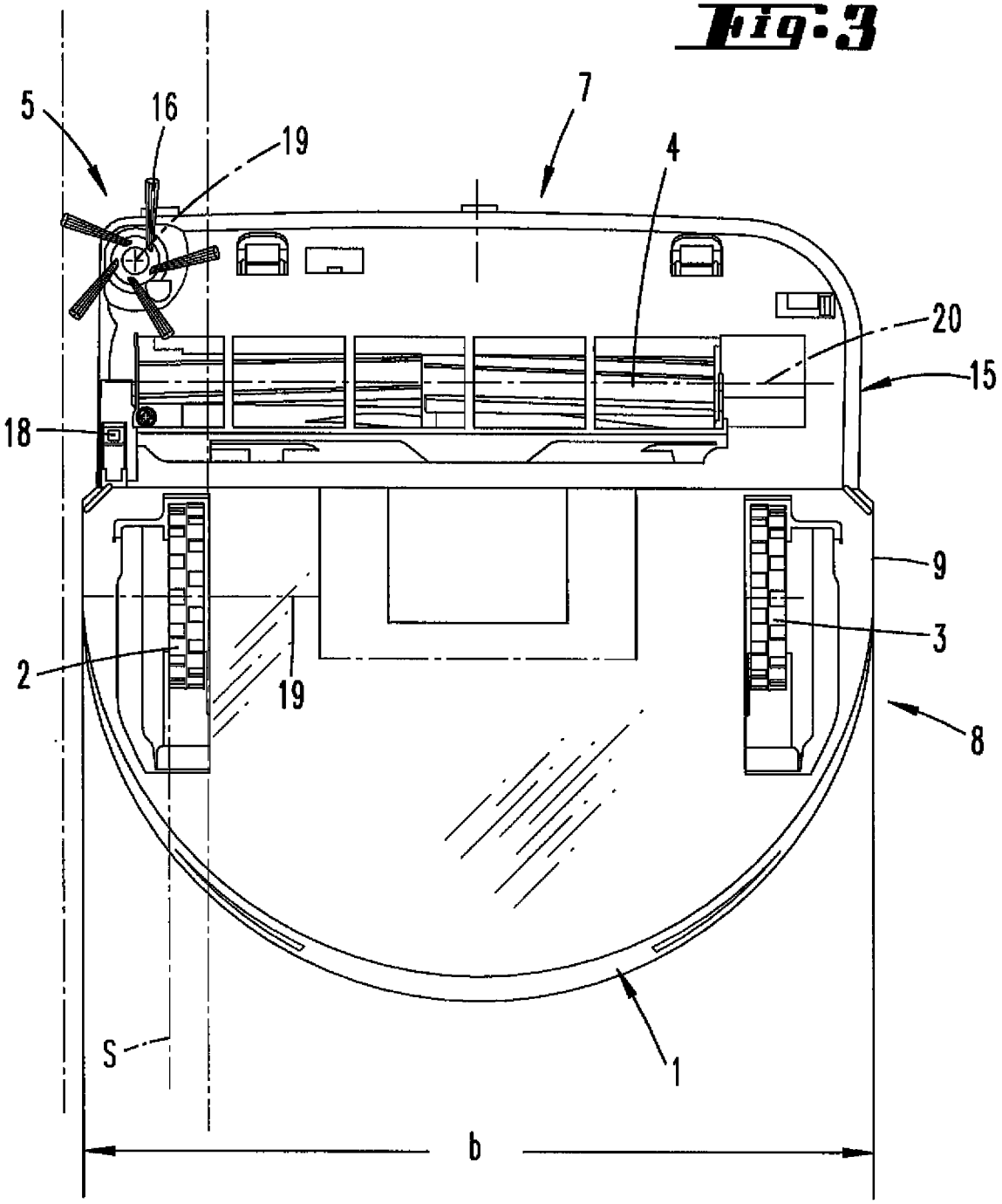
FIG. 3 shows a bottom view of the floor cleaning appliance corresponding to FIG. 1 and FIG. 2, with a possible association of a carpet border during travel.

This floor cleaning appliance, as shown in particular in conjunction with FIG. 3, has two wheels 2, 3, which in the exemplary embodiment are preferably each individually driven.

In addition, the floor cleaning appliance 1 has a cleaning brush 4 which rotates about a substantially horizontal axis, as well as a corner cleaning brush 5 which rotates about a substantially vertical axis, and which in the exemplary embodiment is preferably formed as a disk brush.

The housing 6 is discernible in a top view of the apparatus (specifically, the bottom view being shown in FIG. 3), it being apparent that the boundary edge of the housing (now once again with reference to FIG. 3) essentially comprises a rectangular portion 7 and a circular portion 8. In the exemplary embodiment, the rectangular portion 7 is also formed with a slightly smaller width than the following adjoining circular portion, the circular portion 8 also having a linearly extending portion 9 which is associated with the rectangular portion 7.

In addition, the floor cleaning appliance has a microprocessor and associated electronic memories, not illustrated in detail, as well as a control device and a control program in which traversal routines are stored, or which are creatable or changeable based on measured or detected parameters.

For detecting a space in which the floor cleaning appliance 1 moves, the floor cleaning appliance has a contactless scanning device, in the exemplary embodiment accommodated in the cover portion 10. In this regard, reference is also made to the prior art mentioned at the outset.

Figure 1:
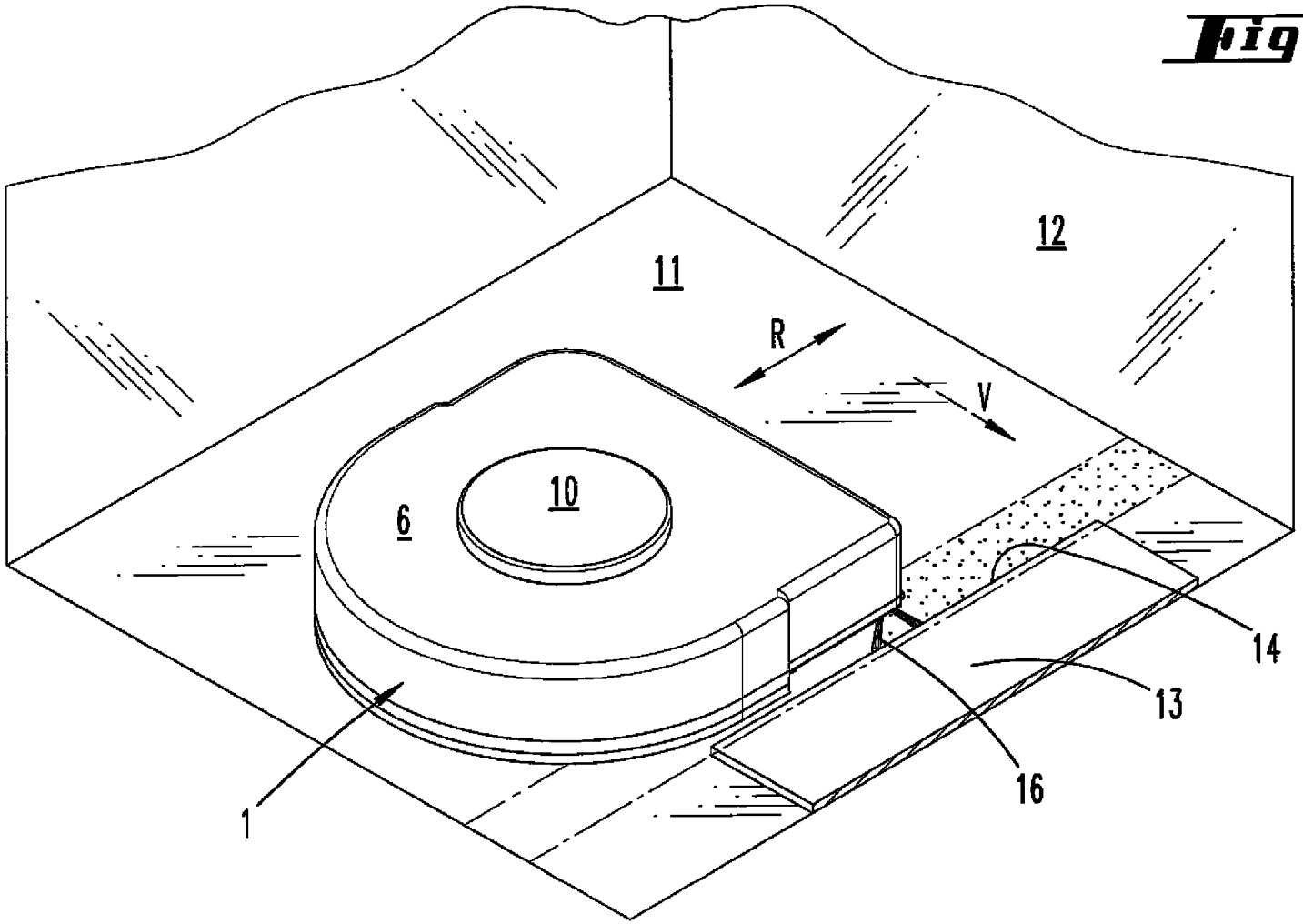
FIG. 1 shows an automatically traveling cleaning appliance during travel along a carpet border.

FIG. 1 illustrates a typical traveling situation of the floor cleaning appliance 1.

The floor cleaning appliance 1 initially travels in the illustrated room 11 along a wall 12, for example, whereby the original direction of travel V illustrated here in dashed lines comes about. In the process, the floor cleaning appliance 1 travels over a carpet 13, which has a carpet border 14 as a lengthwise-extending obstacle. In this ease, the carpet border 14 also stands for an upwardly inclined obstructing surface in general terms.

As the result of detection by sensor, optionally also by the detection by scanning, as described, the floor cleaning appliance 1 may determine the course of the carpet border 14 relative to the original direction of travel V of the floor cleaning appliance. When this particular cleaning mode is in any case selected, which may be optional but which may also be provided as a fixed routine, the floor cleaning appliance makes one or more cleaning passes in a direction of travel R which is aligned extending substantially parallel to the carpet border 14.

In this regard, the travel of the appliance is carried out in particular in such a way that the appliance travels at a distance of an obstructing surface in the direction of travel, in the present case the carpet border 14, for example, from an associated boundary edge of the appliance 1 in the direction of travel that is smaller than that corresponding to a width b of the appliance. This serves in particular to clean the surface in front of the obstacle without making contact with the obstacle. This distance may also be successively reduced, optionally in a plurality of passes. The distance may in particular also be smaller than that corresponding to the mentioned width b, for example up to one-hundredth of the mentioned width, or may even extend to a mode of operation in which the appliance comes into contact with the obstacle.

Figure 2:
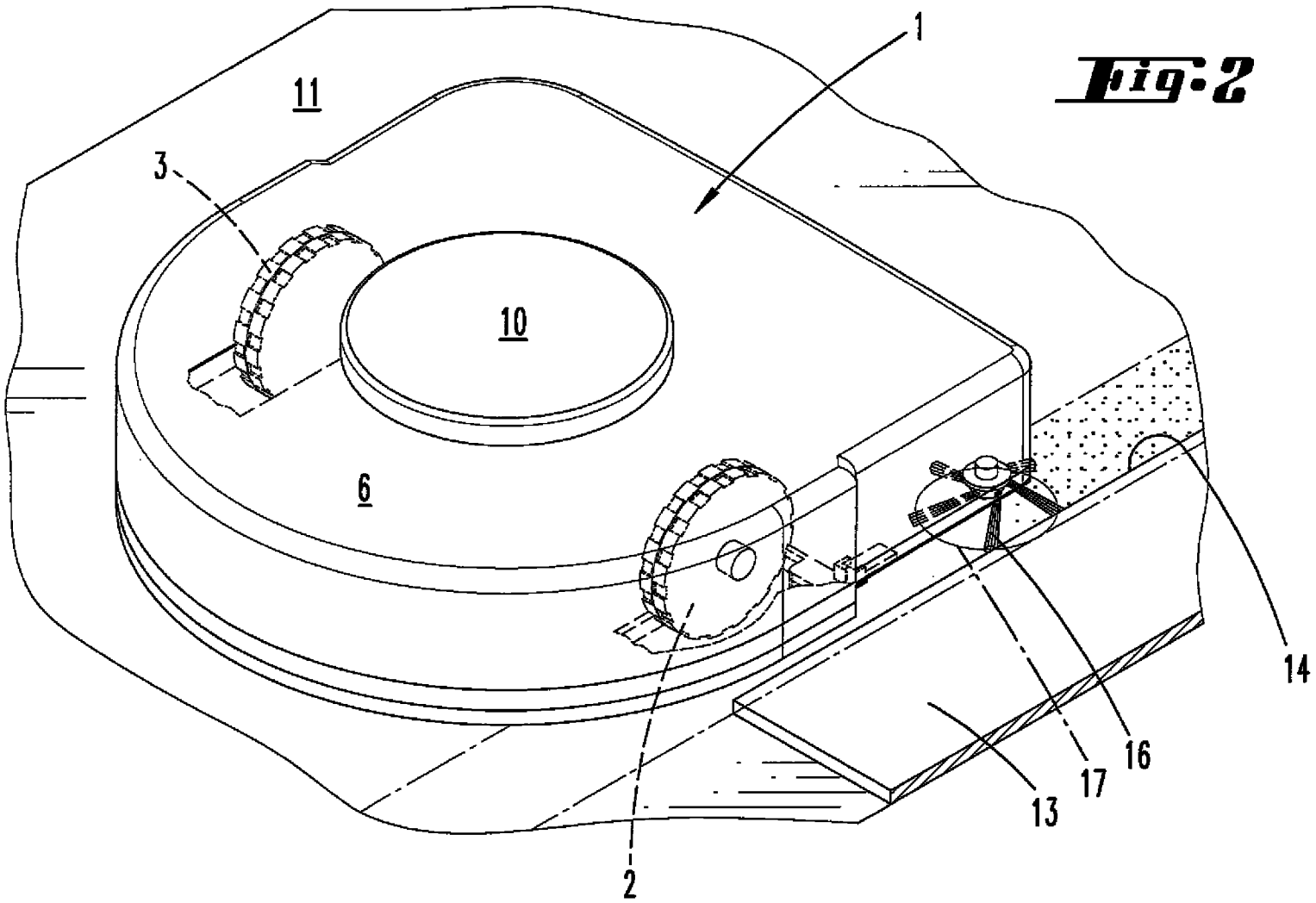
FIG. 2 shows an illustration corresponding to FIG. 1, with an illustration of the arrangement of the wheel and the disk brush in relation to a housing boundary edge.

In addition, the distance of a boundary edge, in the exemplary embodiment in particular a housing edge portion 9 or optionally 15 (compare to FIG. 3) from the carpet border 14, optionally also overlapping with the carpet border 14, may be selected in such a way that a corner cleaning brush 5, if such is provided (as also illustrated in FIGS. 1 and 2), travels at a certain overlap, for example centrally with respect to the carpet border 14, with regard to its circular surface area 17 defined by the cleaning bristles 16. However, for such travel the distance may also be set in such a way that the carpet border 14 extends externally tangentially with respect to the circular surface area 17, or preferably as a slight secant with respect to the circular surface area 17.

Furthermore, the distance may be selected in particular in such a way that when a corner cleaning brush is not provided, an end region of the cleaning brush 4, which rotates about a horizontal axis, cleans the mentioned carpet border 14 during this travel. In this regard, different positions may also be achieved, for example in such a way that an end face of the cleaning brush is associated with the obstacle edge, but travels at a certain distance therefrom, or in contact or overlap with the obstacle edge.

It is further preferred that the floor cleaning appliance 1 (see FIG. 3) has a floor sensor 18 which operates in a contacting or contactless manner. It is apparent that the floor sensor 18 is situated in a sector of the housing contour that, based on a geometric axis 19 of an associated wheel 2 or a geometric axis 20 of the cleaning brush 4, is disposed outside this axis 19 or 20, at the boundary edge side of the housing 6. In another alternative definition, provided that a different configuration is thus achieved, the floor sensor 18, based on the same top view, is situated in a sector of the housing contour, which is delimited by the longitudinal axis of the cleaning brush 4 and a perpendicular S with respect to the geometric wheel axis 20, the perpendicular extending directly outside the running surface of the wheel on a side of the running surface facing the boundary edge of the housing.

The travel along the border may thus also be (co-) controlled by means of this floor sensor. As long as the floor sensor 18 is (already) in overlap with the higher adjacent area of the carpet 13, in the particular cleaning operation of interest here, the floor cleaning appliance travels towards the border 14, preferably with a slight tendency to curve away from the border towards the floor area not covered by carpet, so that a return movement back to the carpet occurs each time the sensor no longer registers overlap with the carpet (in the exemplary embodiment) or the floor obstacle in general.

As an alternative to the recognition of the carpet border 14, or the floor obstacle in general, by the sensor, the upwardly inclined obstructing surface may also be recognized by monitoring the motor current of the corner cleaning brush 5 formed as a disk brush, for example. The recorded motor current may then be detected, for example, by a resistive circuit in this regard and evaluated by a control circuit or a control program of the robotic suction device. During a cleaning pass, on a substantially homogeneous surface, the motor current is present in a relatively small bandwidth, i.e., essentially with a constant value, as a function of the condition of the floor to be cleaned. In the case of traveling over an obstacle, such as a carpet border 14, an increased torque occurs which causes an increase in the motor current. If a further evaluation of a signal, for example of a wall-following sensor, indicates that this increased torque/increase in the motor current is not caused, for example, by reaching a space boundary, such as a wall 12 or a piece of furniture, this increase in the motor current may be assessed by the cleaning appliance 1 as traveling over an obstacle. A routine may then be initiated in which travel occurs back and forth multiple times in the same surface region, so that an increase in the motor current, which always occurs in the same way may be assessed as an edge of an obstacle, for example a carpet border 14, and the direction of travel may be oriented corresponding to this detected border 14. This back-and-forth travel multiple times may also optionally be (initially) carried out for the other described sensors.

Additionally or alternatively, a tactile sensor may be provided, which monitors the floor height toward the outside, directly next to the lateral housing edge. If an elevation in the floor surface, in particular without an additional message from a wall-following sensor, for example, is identified, this may also be interpreted as a flat obstacle in the sense of a carpet border 14. Corresponding to the above description of the change in the direction of travel, here as well, optionally after traveling over such an area multiple times, the direction of travel may then be changed and set in such a way that the desired travel along the obstructing surface results.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE NUMERALS

1 Floor cleaning appliance b Width
2 Wheel
3 Wheel
4 Cleaning brush
5 Corner cleaning brush
6 Housing
7 Rectangular portion
8 Circular portion
9 Portion
10 Cover portion
11 Room
12 Wall
13 Carpet
14 Carpet border
15 Housing edge portion
16 Cleaning bristles
17 Circular surface area
18 Floor sensor
19 Axis
20 Axis
R Direction of travel
S Perpendicular
V Original direction of travel

What is claimed is:

1. A method for operating an automatically traveling floor cleaning apparatus, and for cleaning a carpet boarder surface, comprising:

providing said appliance having a housing with a housing boundary edge and wheels, and the housing is adapted to travel over an obstacle, wherein the obstacle has a border with an upwardly inclined obstacle surface, wherein the upwardly inclined obstacle surface is the carpet border surface, wherein the appliance travels in a first direction of travel of the appliance which is at a right angle or at an acute angle with respect to an extension of the carpet border surface, and in addition the floor cleaning appliance does have a brush and means for detecting the obstacle, said appliance detecting the obstacle;

wherein after the obstacle is detected by the floor cleaning appliance, the first direction of travel of the floor cleaning appliance is changed in such a way that the floor cleaning appliance travels along the carpet border surface in a second direction of travel which is aligned extending substantially parallel to the carpet border surface, wherein there is distance between the housing boundary edge of the appliance and the carpet border surface as the appliance travels in the second direction of travel, and wherein the distance is smaller than a width of the appliance perpendicular to the second direction of travel, and wherein the floor cleaning appliance travels in such a way that the brush achieves a cleaning of the carpet border surface without the appliance traversing the obstacle and in such a way that an end face of the brush is associated with an edge of the obstacle and travels in contact or overlap with the edge of the obstacle;

detecting the carpet border surface with a floor sensor, the floor sensor detecting a change in a vertical height of a floor travelled over, wherein the carpet border surface is detected without the wheels of the appliance being on the obstacle; and wherein the cleaning of the carpet border surface occurs when the floor cleaning appliance is traveling in the second direction; and wherein the cleaning of the carpet border surface is performed without traversing the obstacle; and wherein the appliance travels in the second direction multiple times along the edge of the low obstacle with different distances from the housing boundary edge to the edge of the obstacle, one time of the multiple times with the housing boundary edge not overlapping with the edge of the obstacle, and another time of the multiple times with the housing boundary edge having the floor sensor overlapping with the edge of the obstacle, but without the wheels of the appliance being on the obstacle.

2. The method according to claim 1, wherein the floor cleaning appliance has a wall-following sensor and wherein if a signal of the floor sensor but not of the wall-following sensor is detected, it is assessed that an obstacle is present which may be traveled over but not a border which transitions into a wall is present.

3. The method according to claim 1, wherein said cleaning appliance has a bristle reaching over the housing boundary edge of the appliance.

4. The method according to claim 1, wherein as long as the floor sensor overlaps an adjacent area of the carpet border surface, the floor cleaning apparatus travels in a path curving away from the carpet border surface and each time the floor sensor no longer overlaps the adjacent area of the carpet border surface, the floor cleaning apparatus moves back toward the carpet border surface.

5. The method according to claim 1, wherein the appliance detects reaching or traveling over the obstacle by means of the floor sensor based on a change in a distance from the floor.

6. The method according to claim 1, wherein a motor current consumption of a corner cleaning brush is used for detecting the obstacle.

7. The method according to claim 1, wherein a signal of a tactile sensor is used for detecting the obstacle.

8. The method according to claim 1, wherein the brush of the floor cleaning appliance is a corner cleaning brush with bristles which extend beyond a housing plan view contour, during rotation of the corner cleaning brush, and wherein the contour extends straight in a traveling direction and wherein reaching or traveling over the obstacle is detected based on a change in a motor current of an electric motor which drives the corner cleaning brush.

9. The method according to claim 5, wherein the floor sensor is a sensor which operates in a contactless manner.

10. The method according to claim 5, wherein the floor sensor is formed as a contact sensor, and wherein reaching or traveling over the obstacle is detected by the contact sensor.

11. The method according to claim 5, wherein the floor sensor of the floor cleaning appliance is a wall-following sensor, and wherein reaching or traveling over the obstacle is detected based on an evaluation of a signal of the wall-following sensor.

12. The method according to claim 5, wherein the floor cleaning appliance has a housing, having a housing contour based on a top view, with a first wheel having a running surface, and has a first cleaning brush which has a longitudinal axis, and the longitudinal axis of the first cleaning brush is within the housing contour, and wherein the first wheel and the first cleaning brush are situated within the housing contour, such that an end face of the first cleaning brush extends past the first wheel in a direction toward an edge of the housing contour and wherein the floor sensor, based on the same top view, is situated in a sector of the housing contour between the end face of the first cleaning brush and the edge of the housing contour which sector is delimited by the longitudinal axis of the first cleaning brush and a perpendicular with respect to a geometric axis, the perpendicular extending directly outside the running surface on a side of the running surface facing a boundary edge of the housing; and wherein the floor sensor is facing vertically to the floor for measuring the height of the floor below the floor sensor.

* * * * *